US006525312B1

(12) United States Patent
Cousins

(10) Patent No.: US 6,525,312 B1
(45) Date of Patent: Feb. 25, 2003

(54) MASS SPECTROMETER WITH METHOD FOR REAL TIME REMOVAL OF BACKGROUND SIGNAL

(75) Inventor: Lisa Cousins, Toronto (CA)

(73) Assignee: MDS Inc., Etobicoke (CA)

( * ) Notice: Subject to any disclaimer, the term of this patent is extended or adjusted under 35 U.S.C. 154(b) by 0 days.

(21) Appl. No.: 09/512,603

(22) Filed: Feb. 25, 2000

(51) Int. Cl.[7] ..... H01J 49/42
(52) U.S. Cl. ..... 250/281; 250/282
(58) Field of Search ..... 250/281, 282, 250/287

(56) References Cited

U.S. PATENT DOCUMENTS 6,093,929 A * 7/2000 Javahery et al. ..... 250/282

* cited by examiner

*Primary Examiner*—John R. Lee
*Assistant Examiner*—Anthony Quash
(74) *Attorney, Agent, or Firm*—Bereskin & Parr

(57) ABSTRACT

A mass spectrometer apparatus has one mass analyzer stage for selecting and rejecting ions having a particular mass-to-charge ratio and one fragmentation stage downstream from the first mass analysis stage for causing fragmentation of ions. Another mass analysis stage downstream from the fragmentation stage selects ions of a particular mass-to-charge ratio and rejects other ions. A synchronization unit is connected between the two mass analysis stages, for causing ions excited and removed in the one mass analysis stage to have the same mass-to-charge ratio as the ions selected by the other mass analysis stage, whereby ions detected by the detector are ions selected by the other mass analysis stage and generated by fragmentation in the fragmentation stage.

11 Claims, 4 Drawing Sheets

MASS SPECTROMETER WITH METHOD FOR REAL TIME REMOVAL OF BACKGROUND SIGNAL

FIELD OF THE INVENTION

This invention relates to mass spectrometers, and more particularly relates to multiple stage multipole spectrometers and a technique for removing a background spectrum.

BACKGROUND OF THE INVENTION

Presently, mass spectrometers, particularly triple quadrupole mass spectrometers, are often used to analyze fairly complex reaction or fragmentation schemes. Thus, it is often desired to select a parent ion, fragment the parent ion to generate daughter ions, and subsequently fragment the daughter ions to create further fragment or granddaughter ions. Typically, only a single stage of fragmentation can be performed in a continuous beam triple quadrupole mass spectrometer. Subsequent stages of fragmentation are performed using alternative techniques such as radial excitation, a method common in the field of ion traps. Here the secular frequency $\omega$ of the parent ion is excited using a suitable excitation field such as an auxiliary dipole or quadrupole field. The degree of excitation depends on the amplitude of the auxiliary field; at low voltages, typically less than several volts, the ion is excited, but not ejected. At high amplitudes, typically several volts, the ion is ejected from the rod array and strikes the rods. It is well known that the secular frequency $\omega$ is approximately given by the equation $\omega=(a+q^2/2)\Omega/2$, for $q\leqq 0.4$, where a and q are the stability parameters arising from the Matthieu equation and $\Omega$ is the RF drive frequency. Thus, the excitation field is tuned to a frequency for exciting the parent ion, at an amplitude that yields good fragmentation without ejecting the ion. A detector or mass spectrometer stage is then used to determine the amount of granddaughter or secondary fragmentation ions present, which in turn can be used to determine the structure and composition of the original starting material. The problem with such a scheme is that there are numerous paths by which different components might be present in the final ion sample that is measured. This in turn creates a requirement to track the background spectrum, so as to determine the true spectra created by the secondary fragmentation of a selected primary fragment or daughter ions. For example, some of the ions present in the final sample may not have been created by fragmentation of the selected daughter ion, but rather, may have resulted from the initial fragmentation.

Techniques have been proposed in the art for software subtraction methods, for example by simply subtracting the background from the signal on a point by point basis. These are best suited for cases where the signal of interest is high relative to a low background component, e.g. $S/N>>1$. In contrast, in the sort of scheme outlined above, i.e. continuous flow, multiple stage fragmentation, it is likely for the background signal to be as large or much larger than the signal of interest, $S/N<1$. It is very difficult to resolve this kind of situation downstream of a mass spectrometer.

Further known techniques include using broadband excitation which remove all ions within a specific mass range. Use of a broadband excitation in a continuous flow device is feasible but it requires higher power and implementation is costly and difficult.

The use of resonant excitation to selectively remove specific m/z ions is well known in the field. In a paper entitled "A Technique for Mass Selective Ion Rejection in a Quadrupole Reaction Chamber" by J. Throck Watson et al, there is a proposal to selectively reject from the r.f.-only collision cell of a tandem quadrupole mass spectrometer certain ions, with a view to enhancing analysis of different reactional fragmentation schemes. (*International Journal of Mass Spectrometry and Ion Processes,* 93 (1989) 225–235). A further paper entitled "A Notch Rejection Quadrupole Mass Filter" by Philip E Miller et al (*International Journal of Mass Spectrometry and Ion Processes,* 96 (1990) 17–26) discloses a technique in which a quadrupole is tuned to permit a wide range of masses to be transmitted, and to have a notch which selectively rejects one or more masses. In both these papers, there is no suggestion that the mass selected for rejection be tuned or linked in any way with the later stage in the spectrometer.

Accordingly, in a multiple stage mass spectrometer performing multiple stages of mass spectrometry (MS), particularly where there are multiple fragmentation stages, it is highly desirable to provide some technique for removing the background. More particularly, it is desirable to provide a technique for removing the background in real time or "on the fly" rather than relying on some later processing technique to remove the background.

SUMMARY OF THE INVENTION

In accordance with the present invention, there is provided a mass spectrometer apparatus comprising;

- a first mass analyzer stage for selecting ions having a particular mass-to-charge ratio;
- a fragmentation stage downstream from the first mass analysis stage for causing fragmentation of ions;
- a second mass analysis stage downstream from the fragmentation stage for selecting ions of a particular mass-to-charge ratio and rejecting other ions;
- and a synchronization unit connected between the first and second mass analysis stages, whereby ions excited and removed in the first mass analysis stage have the same mass-to-charge ratio as the ions selected by the second mass analysis stage, whereby ions detected by the detector are ions selected by the second mass analysis stage and generated by fragmentation in the fragmentation stage.

Another aspect of the present invention provides a method of analyzing an ion stream, the method comprising:

(1) selecting ions having a particular mass-to-charge ratio from the ion stream;

(2) causing fragmentation of the remaining ions to generate fragment ions;

(3) subsequently selecting ions having a desired mass-to-charge ratio for detection, and detecting the quantity of ions having the desired mass-to-charge ratio; and (4) synchronizing the selected mass-to-charge ratio in step (1) with the desired mass-to-charge ratio in step (3), whereby detected ions having the desired mass-to-charge ratio will have been generated by fragmentation in step (2).

Both the apparatus and method of the present invention can be applied to a scheme where two or more fragmentation stages take place. In such a situation, there would be provided upstream of the first mass analysis stage, an initial mass analysis or spectrometer stage, for selecting a parent ion, and a further fragmentation stages, for causing fragmentation of the parent ion, to generate daughter ions. These daughter ions would then pass into the first mass analysis stage, for selection, and the fragmentation stage would then generate granddaughter ions from the daughter ions, etc.

Mass analysis and fragmentation can be carried out in any suitable apparatus. However, it is preferred for these steps to be carried out in a quadrupole mass spectrometer. Such a spectrometer can provide a plurality of stages, each comprising a quadrupole rod set aligned with adjacent stages, and configured to carry out the various steps in mass analysis, fragmentation, etc.

BRIEF DESCRIPTION OF THE DRAWING

For better understanding of the present invention and to show more clearly how it may be carried into effect, reference will now be made, by way of example, to the accompanying drawings, in which.

DESCRIPTION OF PREFERRED EMBODIMENT

Figure 1:
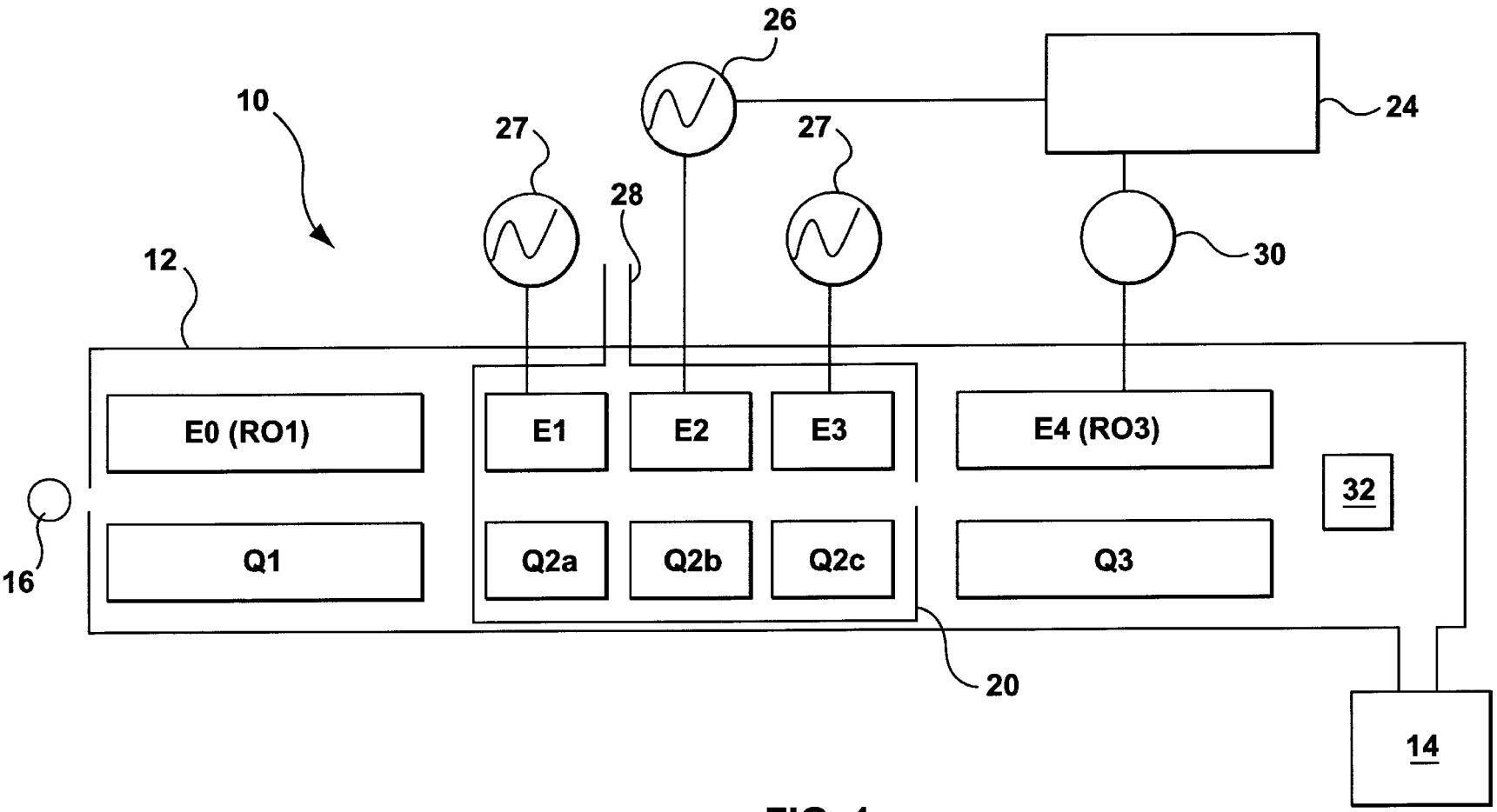
FIG. 1 shows a preferred embodiment of an apparatus of the present invention and which shows schematically a cross-section through an apparatus in accordance with the present invention.

An apparatus in accordance with the present invention is indicated generally by the reference 10. The apparatus 10 includes a housing 12 provided in known manner with a pump 14. The pump 14 can comprise two or more pumps configured in known manner. An ion source is indicated at 16, and this can comprise any suitable ion source, such as an electrospray ion source, and it can operate at atmospheric pressure.

The ion source 16 injects ions into a first quadrupole Q1, which is operated at a low pressure, for example of $2\times10^{-5}$ torr. Downstream from the first quadrupole Q1 is a collision cell 20 including three separate quadrupole sections indicated at Q2*a,* Q2*b* and Q2*c.* As detailed below, the first and last quadrupole sections Q2*a,* Q2*c* in this collision cell 20 are operated in an RF only mode, to cause fragmentation. This is achieved by applying an RF signal and a desired excitation frequency or set of frequencies to excite a particular ion. The excitation for quadrupoles Q2*a,* Q2*c* is sufficient just to cause fragmentation and not loss of the ions.

The central quadrupole Q2*b* is connected to a drive unit 26. It is intended to remove ions with a selected mass, as detailed below.

A third quadrupole Q3 is provided downstream of the collision cell 20. A synchronization unit 24 is connected to a drive unit 30 for the quadrupole Q3 and the drive unit 26 for the quadrupole Q2*b* (as indicated at 27, the quadrupoles Q2*a,* Q2*c* would have respective drive units in known manner).

A detector 32 is provided downstream from the quadrupole Q3, which again can be conventional.

In use, the quadrupole Q1 is operated in a mass selection mode, i.e. with both RF and DC fields applied. The quadrupole Q1 selects a parent ion having a desired mass, for example reserpine 609.

This is passed to the collision cell 20. The first quadrupole in the cell 20, quadrupole Q2*a* is operated in an RF only mode, with a suitable radial excitation field, (typically several kHz to Mhz, 1 mV to several volts) to cause excitation of the parent ion. It then collides with the gas in the collision cell 20. For this purpose, the collision cell is maintained under a pressure of, for example, 7–8 millitorr, with gas supplied through the gas inlet 28. For example reserpine 609 could be fragmented to form fragment or daughter ions with masses 397, 195 and other masses. It is to be appreciated that fragmentation could also be achieved by axial acceleration.

The fragment ions and any remaining parent ions are then passed to the second quadrupole Q2*b,* in the collision cell 20. These ions would comprise any remaining parent ions, and all the daughter or fragment ions. It is desired, ultimately, to detect a secondary fragment or granddaughter ion in the quadrupole Q3.

To prevent interference from the fragments generated from the first fragmentation, the quadrupole Q2*b* is operated to remove selectively ions with this mass. This is achieved by applying a suitable excitation signal of several mV to volts, several kHz to Mhz, in order to effectively notch the background ion. Since the frequency or frequencies of the notch and RF voltage on Q2*b* determine which mass (or masses) is notched, these values are set to correspond to the RF/DC value of quadrupole Q3, using the synchronization unit 24. For example, the quadrupole Q2*b* could be operated to remove ions with a mass of 195, while Q3 is set to transmit 195. (It should be noted that this notching could be performed in Q2*a* so that Q2*b* could be omitted, or put another way Q2*a* and Q2*b* could be combined as mentioned below). It should also be noted that the cells Q2*a,* Q2*b* and Q2*c* could consist of individual collision cells separated by electrostatic lenses and/or differential apertures.

Then, all the fully enclosed remaining ions are passed to the third quadrupole Q2*c* within the collision cell 20. This is operated in the RF only mode with a suitable excitation signal (several kHz to MHz, several mV to volts), to excite a particular daughter or fragment ion, to generate secondary fragments or granddaughter ions. For example, an ion of mass 397 could be excited, which would generate ions of a variety of masses, including ions of a mass of 195.

The ion stream is then passed to the final quadrupole Q3. This is operated at low pressure, and with RF and DC voltages applied, as a mass resolving quadrupole. This is set to pass only ions of a desired mass. Following the example above, it would be set to pass ions having only a mass of 195. These would be detected by the detector 32.

Now, since ions of mass 195 had been eliminated in the quadrupole Q2*b,* one has effectively achieved a total subtraction of a background or interference signal in this quadrupole arrangement. Then, any ions of mass 195 detected at detector 32 can only be as the result of the fragmentation of the ion 397 in the third quadrupole Q2*c.*

The synchronization unit 24 enables the selected masses for the quadrupoles Q2*b,* Q3 to be kept in complete synchronization. Thus, as the mass selected in Q3 is stepped in time or scanned, the excitation frequency is stepped in Q2*b.* For each step, the excitation frequency of Q2*b* ejects a mass corresponding to mass transmitted in Q3. In this way, the only ion to be transmitted is a molecular ion generated by MS/MS/MS in the quadrupole Q2*c.*

While the invention has been described with separate quadrupole rod sets Q2*a,* Q2*b,* these two rod sets could be combined. The combined rod set would then provide the dual function of effecting a first fragmentation step and mass selecting an ion from ions supplied from the source 16. This dual function quadrupole or other device, e.g. an ion trap would be located within the collision cell 20. The following example in FIG. 2 was carried out in an instrument with Q2*a,* Q2*b* combined.

Figure 2A:
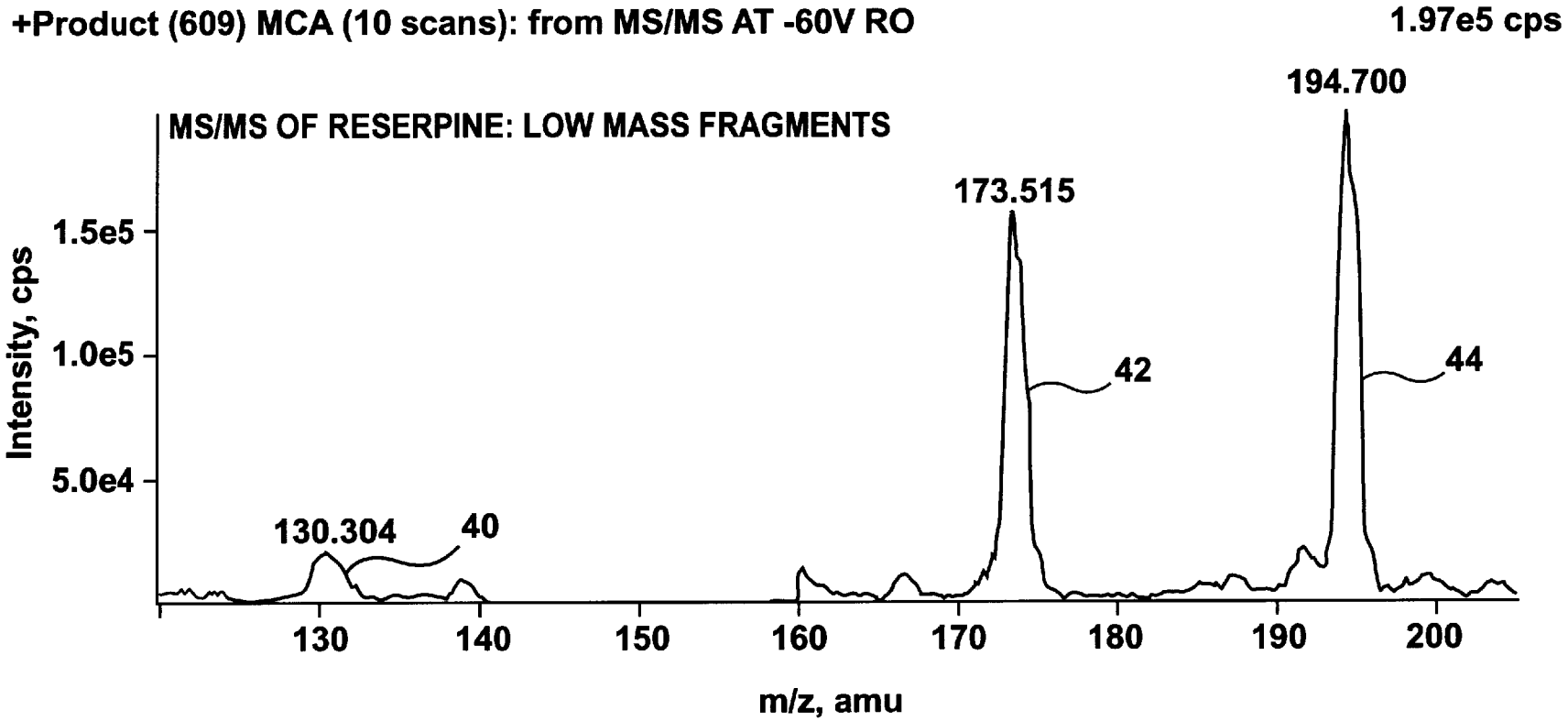
FIGS. 2*a,* 2*b* and 2*c* are mass spectra showing the use of the apparatus of the present invention.

Reference will now be made to FIG. 2, which shows graphs showing characteristics of the apparatus of the present invention. FIG. 2*a* shows a mass spectrum obtained after carrying out two MS steps with an intermediate fragmentation on reserpine. The second MS step was selected to show low mass fragments.

Thus, as shown in FIG. 2*a,* there are significant peaks 40 around mass 130, 42 around mass 173 and 44 around mass 194. If one were to fragment the higher order fragments to generate smaller fragments around mass 130, then the existing peak at 40 would interfere.

Figure 2B:
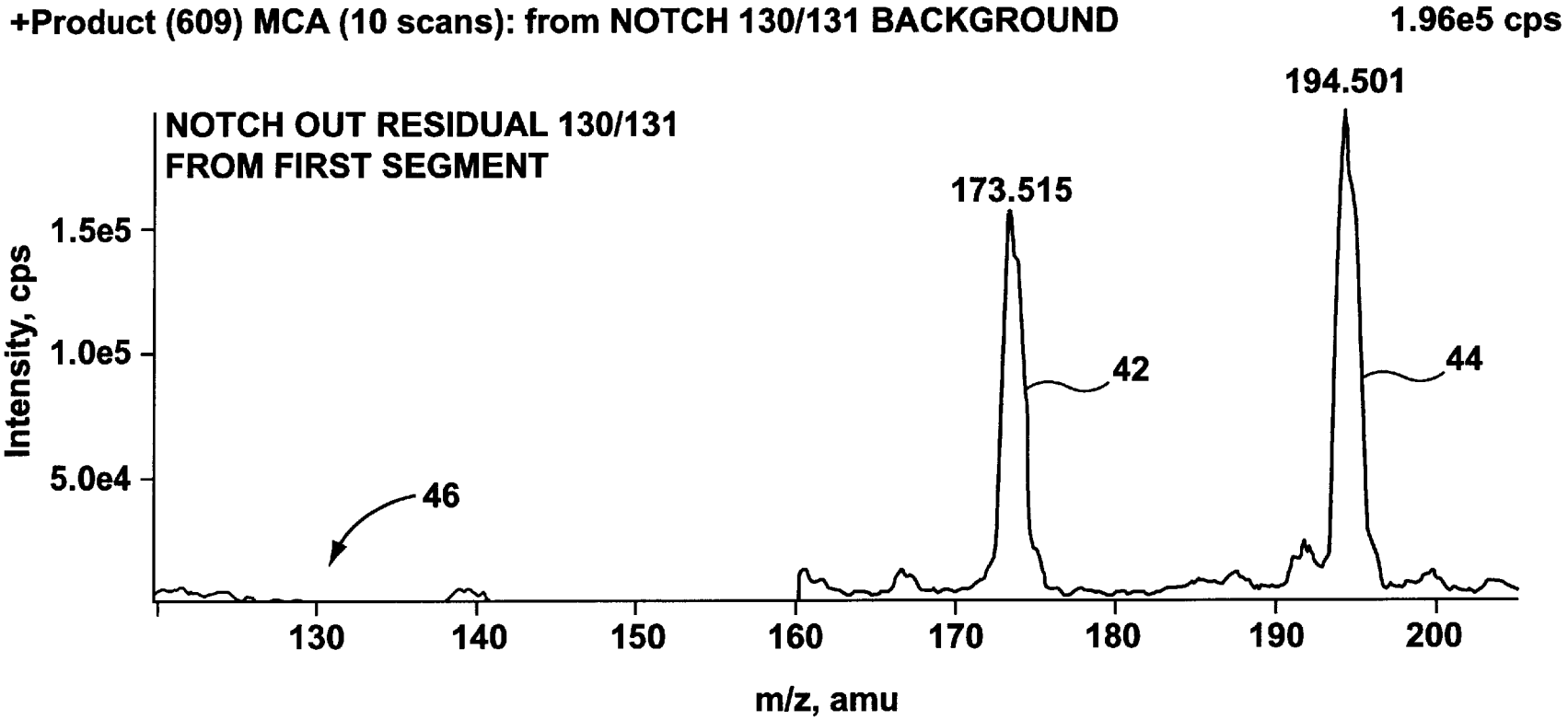

Accordingly, in accordance with the present invention, as a separate experiment, during fragmentation in the combined Q2*a,* Q2*b* section of the instrument, a notch was imposed to remove the peak around 130/131. This is shown in FIG. 2*b.* Thus, FIG. 2*b* still shows the peaks 42 and 44, but as indicated at 46, the notching has removed the peak that was previously present and substantially eliminated the background around m/z 130/131. Then, the fragments can be subjected to a further fragmentation step, e.g. as in quadrupole Q2*c* in which excitation of m/z 174 is affected. The results are shown in FIG. 2*c.*

Figure 2C:
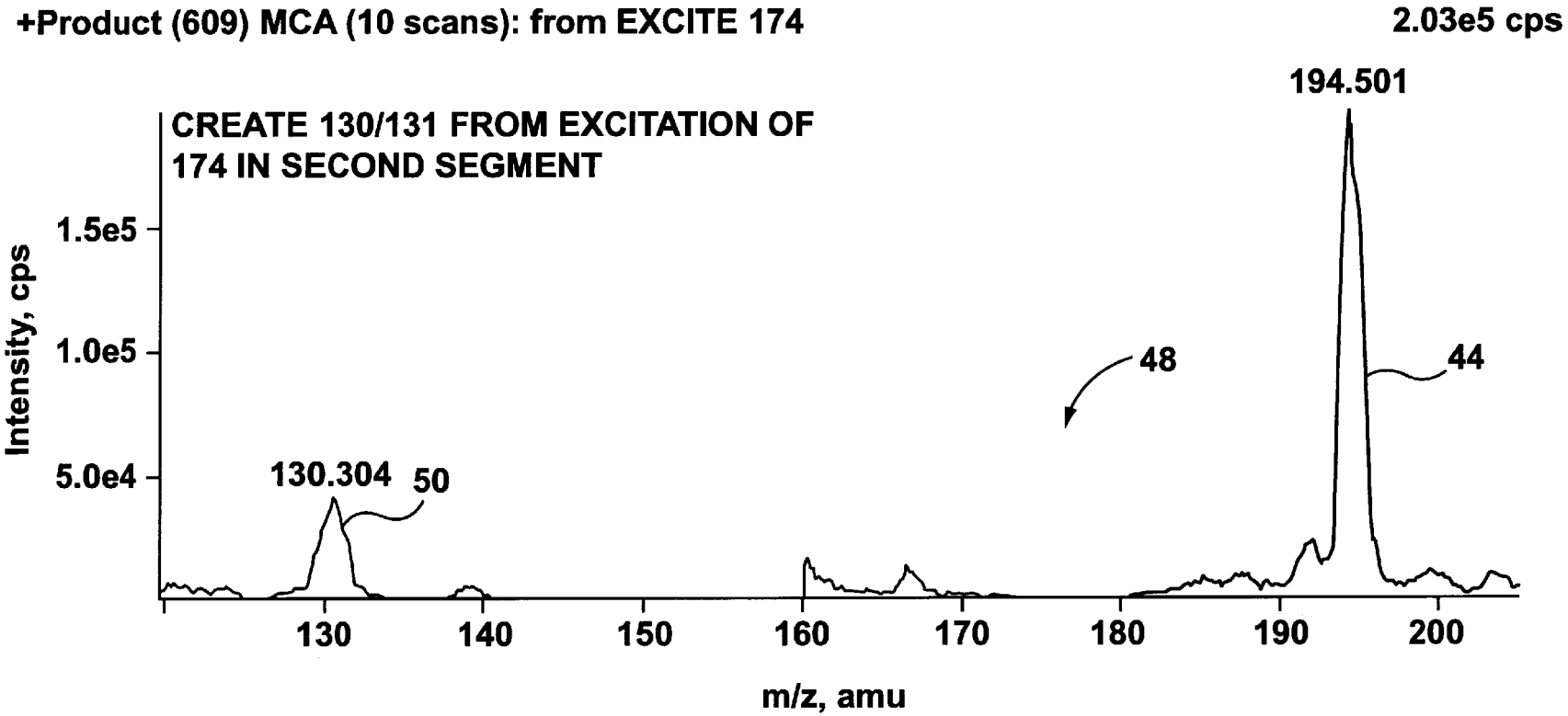

As shown in FIG. 2*c,* the peak 44 is still present, but as indicated at 48, the peak formerly present around mass 173/174 has been eliminated by the fragmentation step. This fragmentation generates smaller fragments, including a substantial new peak 50 around mass 130.

Since the former peak 40 was removed by notching as shown in FIG. 2*b,* it is certain that the new peak 50 is the result solely of fragmentation of the mass 174 ions, and no allowance needs to be made for any background effect.

A further aspect of the present invention is to improve the mass resolution of the fragmentation step in quadrupole Q2*c.* Thus, the intention of this quadrupole is to excite an ion of a particular mass or mass-to-charge ratio. However, the excitation provided may, in fact, excite ions in the range of, for example, 10 AMU. This is undesirable.

To mitigate or reduce this effect, a further aspect of the present invention is to additionally provide for the quadrupole Q2*b* to remove, in addition to the ions synchronized with the quadrupole Q3, ions on either side of the ion to be fragmented in Q2*c.*

Thus, in effect, "notches" could be provided on either side of the ion to be removed in Q2*c.* These notches would have precise edges, so the notches could be set so as to leave a narrow band width, for example 5 AMU, around the desired ion for fragmentation in Q2*c.*

Unlike standard ion traps, notches only are required, rather than broadband excitation presequence, since the background removal and synchronization method ensures that the ion measured is indeed a fragment ion. Since the resolution into Q2*c* is not that poor, it is only necessary to eliminate ions immediately on either side of the ion of interest to be fragmented in Q2*c.* As such, it is anticipated that the wave forms required would be a combination of sinusoids of different frequencies, but in view of the narrow width required for these notches, no great power requirements would be required.

As noted above, in comparison, software subtraction methods are best suited for cases where the signal of interest is very high. For continuous flow, multiple stage fragmentation, it is likely that the background signal is as large or much larger than the signal of interest, and this situation is very difficult to resolving using software subtraction.

It is also to be realized that while quadrupole mass analyzers have been shown, any suitable mass analysis technique could be used. For example, the final quadrupole Q3 and detector 32 could be replaced by a time-of-flight section, where the arrival time bins would be synchronized with the notch.

What is claimed is:

1. A mass spectrometer apparatus comprising:

one mass analysis stage for rejecting ions having a given range of mass-to-charge ratios and transmitting all other ions;

one fragmentation stage downstream from the first mass analysis stage for causing fragmentation of said transmitted ions;

another mass analysis stage downstream from the fragmentation stage for selecting ions having the same mass-to-charge ratios as the ions rejected by said one mass analysis stage and rejecting other ions; and a synchronization unit connected between said one and said other mass analysis stages, to cause the ions rejected by said one mass analysis stage to have the same mass-to-charge ratios of the ions selected by said other mass analysis stage, whereby ions detected by the detector are ions selected by said other mass analysis stage and generated by fragmentation in said one fragmentation stage.

2. An apparatus as claimed in claim 1, which includes a further mass analysis and fragmentation stage before said one mass analysis stage, the mass analysis and fragmentation stage having an inlet for ions, and in use, being operated to select ions having a desired mass-to-charge ratio and to cause those selected ions to collide with a gas and fragment, the resulting fragment ions passing into said one mass analysis stage.

3. An apparatus as claimed in claim 2, wherein the mass analysis and fragmentation stage comprises: a first mass analyzing quadrupole, connectable to a supply of both RF and DC voltages; and a first fragmentation stage connected to the first mass analysis stage, for receiving mass selected ions therefrom, wherein the said one and said other mass analysis stages comprise second and third mass analysis stages and said one fragmentation stage comprises a second fragmentation stage.

4. A method of analyzing an ion stream, the method comprising:

(1) selectively removing ions having a given range of mass-to-charge ratios and transmitting all other ions;

(2) causing fragmentation of a selected ion of the remaining ions to generate fragment ions;

(3) subsequently selecting ions having the same mass-to-charge ratios as the ions rejected in step (1) for detection; and

(4) synchronizing the selected mass-to-charge ratios, wherein the ions removed in step (1) have the same mass-to-charge ratios of the ions selected by said other mass analysis stage.

5. A method as claimed in claim 4, which includes, prior to step (1), the following additional steps:

(a) receiving ions from an ion source and selecting ions having a desired mass-to-charge ratio; and (b) subjecting selected ions from step (a) to a first fragmentation step, to form fragment ions, wherein the fragment ions are then subject to step (1) of the method.

6. A method as claimed in claim 5, wherein steps (b) and (1) are carried out in a common quadrupole rod set.

7. A method as claimed in claim 4, 5, or 6, wherein step (1) includes removing ions on either side of the ion to be selected in step (2), to improve the resolution of the fragmentation in step (2).

8. An apparatus as claimed in claim 1, wherein the one mass analysis stage rejects an ion having one mass-to-charge ratio, and the other mass analysis stage selects ions having the same mass-to-charge ratio.

9. An apparatus as claimed in claim 1, wherein the range of mass-to-charge ratios is no more than 5 AMU in width.

10. A method as claimed in claim 4, wherein step (1) selectively remove an ion having one mass-to-charge ratio, and step (3) selects ions having the same mass-to-charge ratio.

11. A method as claimed in claim 4, wherein the range of mass-to-charge ratios is no more than 5 AMU in width.

* * * * *